US005176384A

United States Patent [19]

Sata et al.

[11] Patent Number: 5,176,384

[45] Date of Patent: Jan. 5, 1993

[54] IRON TYPE GOLF CLUB HEAD

[75] Inventors: Takeo Sata; Kenzaburo Iijima; Toshiharu Hoshi, all of Hamamatsu, Japan

[73] Assignee: Yamaha Corporation, Hamamatsu, Japan

[21] Appl. No.: 359,343

[22] Filed: May 31, 1989

[30] Foreign Application Priority Data

May 31, 1988 [JP] Japan ..... 63-71937

[51] Int. Cl.[5] ..... A63B 53/04

[52] U.S. Cl. ..... 273/167 R; 273/167 J; 273/173; 273/78

[58] Field of Search ..... 273/167-175

[56] References Cited

U.S. PATENT DOCUMENTS

| | | | |
|---|---|---|---|
| 1,423,341 | 7/1922 | Lippincott | 273/173 |
| 4,181,306 | 1/1980 | Jepson | 273/173 |
| 4,252,262 | 2/1981 | Igarashi | 273/173 X |
| 4,792,139 | 12/1988 | Nagasaki et al. | 273/167 H |
| 4,798,383 | 1/1989 | Nagasaki et al. | 273/167 H |
| 4,809,978 | 3/1989 | Yamaguchi | 273/78 |

FOREIGN PATENT DOCUMENTS

| | | | |
|---|---|---|---|
| 60-7873 | 12/1984 | Japan | 273/167 R |
| 59-228873 | 12/1984 | Japan | 273/167 J |
| 59-228874 | 12/1984 | Japan | 273/167 J |
| 59-228875 | 12/1984 | Japan | 273/173 |
| 60-7872 | 1/1985 | Japan . | |
| 2181657 | 4/1987 | United Kingdom | 273/167 H |

OTHER PUBLICATIONS

C. M. Wayman, "Some Applications of Shape-Memory Alloys", Journal of Metals, Jun., 1980, pp. 129-137.

*Primary Examiner*—V. Millin
*Assistant Examiner*—Sebastiano Passaniti
*Attorney, Agent, or Firm*—Burns, Doane, Swecker & Mathis

[57] ABSTRACT

An iron type golf club head includes a head body constituted by a blade portion, a sole portion, and an impact surface portion. At least the impact surface portion of the head body is constituted by a thin plate consisting of a thermoelastic type martensite transformation alloy. The thickness of the impact surface portion is set in the range of 1.0 to 5.0 mm, and is smaller than that of each of the blade and sole portions of the head body.

13 Claims, 1 Drawing Sheet

IRON TYPE GOLF CLUB HEAD

BACKGROUND OF THE INVENTION

The present invention relates to an iron type golf club head having a head impact face portion whose structure is improved and, more particularly, to an iron type golf club head wherein the impact face portion of a head body is constituted by a thin plate consisting of a thermoelastic type martensite transformation alloy so as to improve directional stability upon impact and increase a carry.

Conventional golf club heads having various structures have been proposed. For example, Japanese Patent Laid-Open (Kokai) No. 59-228874 discloses a wood type club head having a solid or hollow structure and constituted by a wood material such as persimmon, a metal material such as stainless steel, and a high-modulus material obtained by using carbon fiber as a reinforcing material, i.e., carbon fiber reinforced plastic called CFRP. Japanese Patent Laid-Open (Kokai) No. 60 7873 discloses an iron type club head in which the impact face portion of a head body is constituted by an Ni-Ti alloy containing 50 to 60 wt. % of Ni with the balance of Ti, or by a thermoelastic type martensite transformation alloy in which part of Ni or Ti of an Ni-Ti alloy is substituted with at least one element selected from the group consisting of Fe, Co, Zr, V, Cu, and Al. In addition, Japanese Patent Laid-Open (Kokai) No. 60-7872 discloses a wood type club head, in which the impact face portion of a head body is constituted by a Cu thermoelastic type martensite transformation alloy containing at least one element selected from the group consisting of Zn, Al, Ni, Si, Sn, Mn, Ag, Mg, Sb, Ga, Ge, and In within the range in which a 8 brass structure can be obtained with the balance of Cu.

In such a golf club structure, since the impact face portion of a head body is made of a thermoelastic type martensite transformation alloy exhibiting thermoelastic martensite transformation within the temperature range of −120° C. to +20° C., super elastic behavior upon rebounding of a ball due to flexibility based on a stress-induced martensite caused upon impact can be utilized to increase the contact area of the head with the ball and prolong a contact time. Therefore, so-called "ball holding" is good. As a result, the directivity of the hit ball is stable, and the carry can be increased.

In the above-described club head, however, the impact face portion of a head body is simply constituted by thermoelastic type martensite transformation alloy exhibiting thermoelastic martensite transformation, and the head body has a solid structure while the impact face portion is backed up by another head material. In such a club head, even though the head body has a hollow structure, if the thermoelastic type martensite transformation alloy has a normal thickness of about 6 to 10 mm, super elastic behavior upon rebounding of a ball due to flexibility based on a stress-induced martensite caused upon impact cannot be efficiently utilized. Therefore, the effects of improving energy transmission with an increase in contact area of the head with a ball and prolonging a contact time cannot be fully realized.

SUMMARY OF THE INVENTION

The present invention has been made in consideration of the above situation, and has as its object to provide an iron type golf club head capable of efficiently utilizing super elastic behavior upon rebounding of a ball due to flexibility based on a stress-induced martensite caused upon impact.

In order to achieve the above object, according to the present invention, there is provided an iron type golf club head comprising a head body constituted by a blade portion, a sole portion, and an impact surface portion, wherein at least the impact surface portion of the head body is constituted by a thin plate consisting of a thermoelastic type martensite transformation alloy, and a thickness of the impact surface portion is set in a range of 1.0 to 5.0 mm and is smaller than that of each of the blade and sole portions of the head body.

According to the present invention having the above-described arrangement, since the impact face portion of the head body is constituted by a thin plate consisting of a thermoelastic type martensite transformation alloy, super elastic behavior upon rebounding of a ball due to flexibility based on a stress-induced martensite caused upon impact can be efficiently utilized.

DETAILED DESCRIPTION OF THE PREFERRED EMBODIMENTS

Preferred embodiments of the present invention will be described in detail below with reference to the accompanying drawings.

Figure 1:
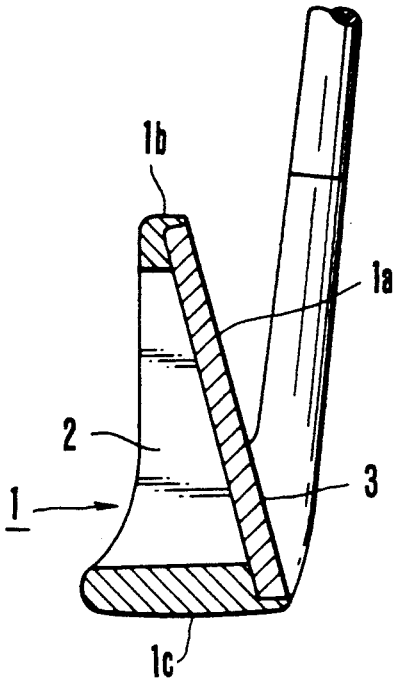
FIG. 1 is a sectional view showing a main part of an iron type golf club head according to an embodiment of the present invention.
Figure 2:
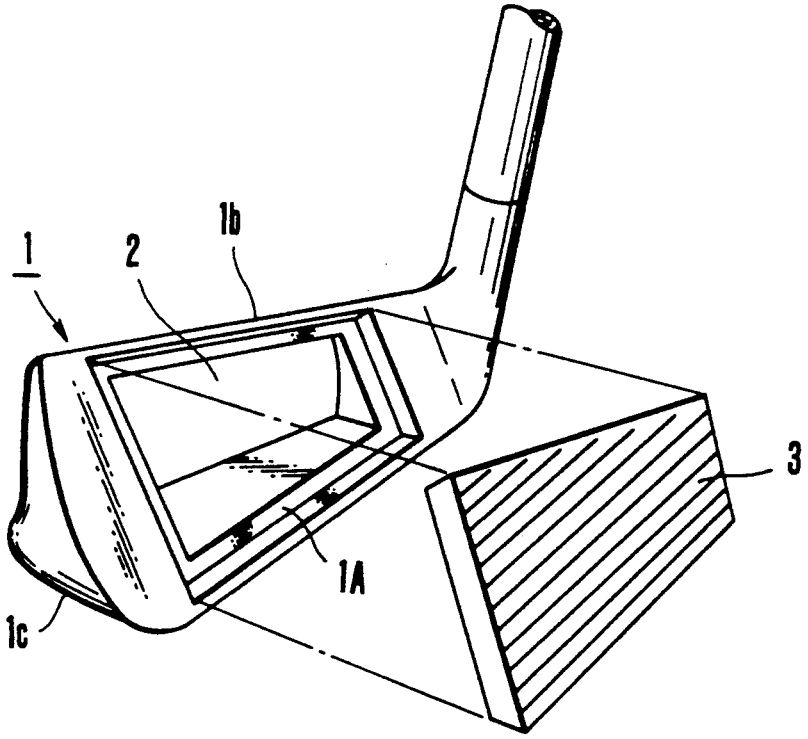
FIG. 2 is an exploded perspective view of the club head in FIG. 1.

FIGS. 1 and 2 show an iron type golf club head according to a first embodiment of the present invention. Referring to FIGS. 1 and 2, reference numeral 1 denotes a head body constituted by, e.g., a metal material such as stainless steel, cast iron, or brass, or CFRP. The head body 1 has a triangular sectional area obtained by increasing its thickness from a blade portion **1*b* on the upper edge to a sole portion 1*c* on the lower edge such that an impact face portion 1*a* has a predetermined degree of loft. In addition, an opening portion 2 is formed while a portion 1A for supporting the periphery of the impact face portion 1*a* is left. A thin plate 3 consisting of a thermoelastic type martensite transformation alloy is bonded to the impact face portion 1*a* so as to seal the opening portion 2**.

The thickness of the thin plate 3 consisting of a thermoelastic type martensite transformation alloy and constituting the impact face portion **1*a* of the head body 1 is set to be 1.0 to 5.0 mm, preferably, in the range of 1.0 to 3.0 mm. The thickness of the thin plate 3 is set to be smaller than that of the blade portion 1*b* or the sole portion 1*c* of the head body 1. The thin plate 3** constituted by an Ni-Ti thermoelastic type martensite transformation alloy, an Ni-Ti thermoelastic type martensite transformation alloy in which part of Ti of an Ni-Ti alloy is substituted with 0.1 to 2.0 wt. % of at least one element selected from the group consisting of Pt, Pd, Fe, Co, V, Cu, and Al, or a Cu thermoelastic type martensite transformation alloy, each exhibiting a thermoelastic martensite transformation in the temperature range of −120° C. to +20° C.

Figure 3:
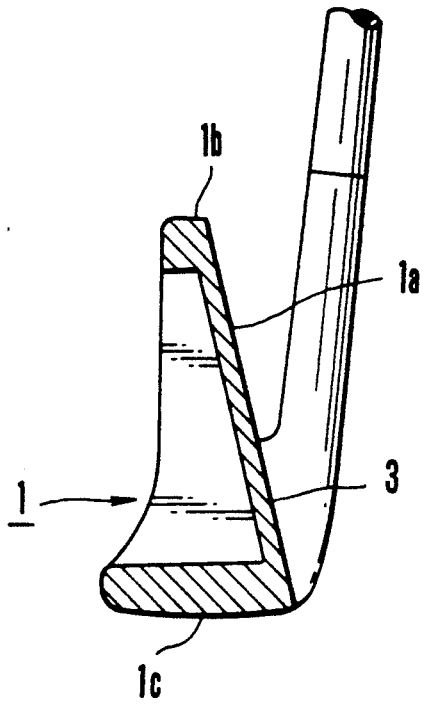
FIG. 3 is a sectional view showing a main part of a second embodiment of the present invention.

FIG. 3 shows a second embodiment of the present invention, wherein a head body 1 and a thin plate 3 consisting of a thermoelastic type martensite transformation alloy and constituting an impact face portion 1*a* are integrally formed by using the same material.

EXAMPLE 1

Impact face portion samples of a head body of the present invention were made of a 56Ni-Ti alloy as a thermoelastic type martensite transformation alloy. Impact face portion samples of a conventional head body were made of, e.g., a 18Cr-8Ni-Fe alloy. Carry and directional stability with respect to changes in thickness (mm) of the impact face samples were compared by using symbols ⊚, ○, Δ, and x respectively representing superiority which decreases in this order. The following table shows the comparison result.

TABLE

| | | Thickness | Carry | Directional Stability |
|---|---|---|---|---|
| Prior Art | 18Cr—8Ni—Fe | 10 | ○ | x |
| | | 8 | ○ | x |
| | | 6 | ○ | x |
| | | 5 | ○ | Δ |
| | | 4 | ○ | Δ |
| | | 3 | Δ | ○ |
| | | 2 | Δ | ○ |
| | | 1 | Δ | ○ |
| | | 0.5 | damaged | damaged |
| Present Invention | 56Ni—Ti | 10 | Δ | x |
| | | 8 | Δ | x |
| | | 7 | Δ | x |
| | | 6 | Δ | Δ |
| | | 5 | ○ | ○ |
| | | 4 | ○ | ○ |
| | | 3 | ○ | ⊚ |
| | | 2 | ○ | ⊚ |
| | | 1 | ○ | ⊚ |
| | | 0.5 | damaged | damaged |

EXAMPLE 2

Impact surface portion samples of a head body of the present invention were made of a Cu thermoelastic type martensite transformation alloy. Five-iron club samples were exemplified, and their carries and directional stability with respect to changes in thickness (mm) of impact surface samples were measured. The following table shows the measurement result.

(a) Cu-Zn-Al alloy

Composition: Cu-27.5Zn-4.5Al

Martensite Transformation Temperature: −140° C.

TABLE

| Thickness of Impact Surface Portion | Carry | Directional Stability |
|---|---|---|
| 10 | Δ | x |
| 9 | Δ | x |
| 8 | Δ | x |
| 7 | Δ | Δ |
| 6 | Δ | Δ |
| 5 | ○ | ○ |
| 4 | ○ | ○ |
| 3 | ○ | ⊚ |
| 2 | ○ | ⊚ |
| 1 | ○ | ⊚ |
| 0.5 | damaged | damaged |

(b) Cu-Al-Ni alloy

Composition: Cu-14.5Al-4.4Ni

Martensite Transformation Temperature; −140° C.

TABLE

| Thickness of Impact Surface Portion | Carry | Directional Stability |
|---|---|---|
| 10 | Δ | x |
| 9 | Δ | x |
| 8 | Δ | x |
| 7 | Δ | Δ |
| 6 | Δ | Δ |
| 5 | ○ | ○ |
| 4 | ○ | ○ |
| 3 | ○ | ⊚ |
| 2 | ○ | ⊚ |
| 1 | Δ | ⊚ |
| 0.5 | damaged | damaged |

As is apparent from the above description, according to present invention, an impact surface portion of a head body is made of a thin plate consisting of a thermoelastic type martensite transformation alloy, and its thickness is set in the range of 1.0 to 5.0 mm so as to be smaller than that of each of the blade and sole portions of the head body. Since the impact surface portion is made of a thin plate consisting of a thermoelastic type martensite transformation alloy, super elastic behavior upon rebounding of a ball due to flexibility based on a stress-induced martensite caused upon impact can be efficiently utilized, thereby providing an iron type golf club head capable of improving directional stability upon impact and increasing the carry.

What is claimed is:

1. An iron type golf club head comprising:

a head body constituted by a blade portion, a sole portion, and an impact surface portion, wherein at least said impact surface portion of said head body is constituted by a thin plate consisting of a thermoelastic type martensite transformation alloy comprising a NiTi alloy of CuZnAl alloy or CuNiAl alloy, and a thickness of said impact surface portion is set in the range of 1.0 to 5.0 mm and is smaller than that of each of said blade and sole portions of said head body.

2. A head according to claim 1, wherein said thermoelastic type martensite transformation alloy consists of an Ni-Ti alloy in which part of Ti is substituted with 0.1 to 2.0 wt. % of at least one element selected from the group consisting of Pt, Pd, Fe, Co, V, Cu, and Al.

3. A head according to claim 1, wherein said blade and sole portions and said impact surface portion of said head body are integrally formed by using a material consisting of the thermoelastic type martensite transformation alloy.

4. A head according to claim 1, wherein said impact surface portion has an opening and said thin plate is disposed to seal said opening.

5. An iron type golf club head comprising:

a head body including a blade portion, a sole portion and an impact surface portion;

said head body including means for improving directional stability of a golf ball when the golf ball is struck with said impact surface portion and for increasing a distance the ball travels after being struck with said impact surface portion, said means comprising a thin plate which constitutes said impact surface portion, said thin plate comprising a thermoelastic type martensite transformation alloy which exhibits super elastic behavior due to stress-induced martensite formed upon impact with the ball sot hat a larger contact area and contact time between the ball and the thin plate can be obtained, said thin plate having a thickness of 1.0 to 5.0 mm.

6. The head according to claim 7, wherein said thickness of said thin plate is less than that of said blade and sole portions of said head body.

7. The head according to claim 5, wherein said blade portion has a thickness which is less than that of said sole portion.

8. The head according to claim 5, wherein said thin plate comprises a NiTi alloy.

9. The head according to claim 5, wherein said thin plate comprises a NiTi alloy wherein part of Ti is substituted with 0.1 to 2.0 wt. % of at least one element selected from the group consisting of Pt, Pd, Fe, Co, V, Cu and Al.

10. The head according to claim 5, wherein said thin plate comprises a Cu-Zn-Al alloy.

11. The head according to claim 5, wherein said thin plate comprises a Cu-Ni-Al alloy.

12. The head according to claim 5, wherein said blade portion, said sole portion and said thin plate comprise said thermoelastic type martensite transformation alloy and said blade portion, said sole portion and said thin plate are integral with each other.

13. The head according to claim 5, wherein said head body includes an opening extending therethrough, said opening being located between said blade and sole portions and said thin plate covering said opening such that one side of said thin plate faces said opening and an opposite side of said thin plate comprises a ball striking surface.

* * * * *